United States Patent [19]

Gibson et al.

[11] 3,945,320

[45] Mar. 23, 1976

[54] WATER-RESISTANT FUSE-CORD

[75] Inventors: Andrew Gibson, Saltcoats; Trevor John Turner, Ardrossan, both of Scotland

[73] Assignee: Imperial Chemical Industries Limited, London, England

[22] Filed: June 14, 1974

[21] Appl. No.: 479,524

[30] Foreign Application Priority Data

July 4, 1973 United Kingdom ..... 31769/73

[52] U.S. Cl. ..... 102/27 R; 86/1 R; 86/22

[51] Int. Cl.[2] ..... C06C 5/04

[58] Field of Search ..... 102/24, 27, 28, 29; 86/1, 86/22

[56] References Cited

UNITED STATES PATENTS

| | | | |
|---|---|---|---|
| 3,279,372 | 10/1966 | Patterson | 102/28 M |
| 3,384,688 | 5/1968 | Gow et al. | 102/27 |
| 3,430,566 | 3/1969 | Patterson | 102/28 M |
| 3,621,559 | 11/1971 | Welsh | 102/27 |

FOREIGN PATENTS OR APPLICATIONS

| | | | |
|---|---|---|---|
| 1,120,200 | 7/1968 | United Kingdom | 102/27 |

*Primary Examiner*—Verlin R. Pendegrass
*Attorney, Agent, or Firm*—Cushman, Darby & Cushman

[57] ABSTRACT

A water-resistant explosive fuse-cord having water-soluble or water-swellable macromolecular material adjacent to textile material surrounding the explosive core.

27 Claims, 1 Drawing Figure

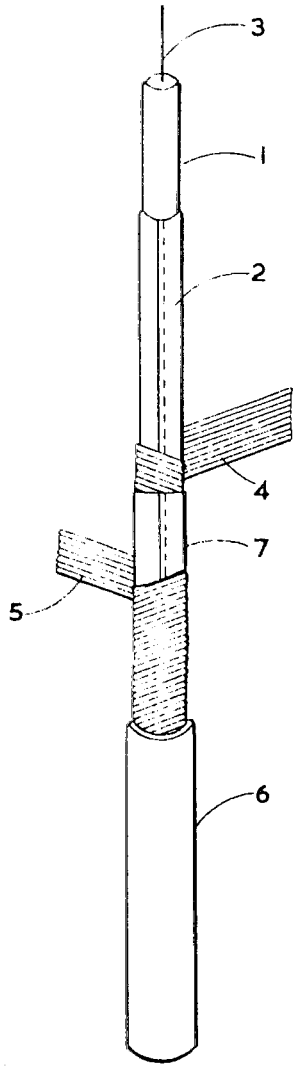
3
1
2
4
7
5
6

WATER-RESISTANT FUSE-CORD

This invention relates to explosive fuse-cord and to a method of manufacturing explosive fuse-cord. The invention is especially useful for providing fuse-cords for underwater use.

In the well known dry process for the manufacture of detonating fuse-cord a core of dry particulate explosive material is encased in a thin tube of paper or plastics material. reinforced with wrapping material usually comprising one or more spun layers of textile yarns surrounded by an outer sheath of thermoplastics material. In the manufacture of cords of this construction, the thin tube is continuously formed from tape, usually longitudinal tape, which is curved around its longitudinal axis to form the tube by passing it through a die. The explosive is continously fed from a hopper into the tube as the tube is being formed and is consolidated by passing the tube through dies to form the explosive core. Textile yarns on bobbins rotating around the tube are continuously helically wound around the tube and the outer sheath is extruded around the yarns. Detonating cords produced by this process are described in the art as dry spun fuse-cords (and are thereby distinguished from fuse-cords made by the wet process in which the explosive core is formed from a slurry of explosive suspended in thickened water).

The explosive materials normally used in fuse-cords are readily desensitised by water. Thus a fuse-cord with a core of crystalline pentaerythritol tetranitrate will become waterlogged and fail to propagate detonation if the end of the cord is immersed in water for a period of time. To counteract this the explosive powder has been treated with waterproofing coating agents but these were only effective to a depth of 15 cm of water. For use at greater water depths it was preferable to mix about 1 to 2% by weight of a water-gellable material, for example guar gum, with the explosive powder and this had the effect of forming a relatively impenetrable barrier of gelled material at the exposed end of the explosive core and thereby slowing the ingress of water. This treatment has not, however, been completely successful because, although the water is prevented from migrating through the end of the explosive core, it has been surprisingly found that water migration still occurs along the textile layer. Since the aforementioned thin tube is water permeable, water penetrates the explosive core from the side over a long distance from the end and the explosive material becomes waterlogged and insensitive. Thus, detonating cord may fail to ignite from a detonator, or, if successfully ignited, may fail to propagate detonation.

It is an object of this invention to provide an improved construction of explosive fuse-cord which is more resistant to water migration through textile materials in the cord when the cord is used underwater.

In accordance with this invention, an explosive fuse-cord comprises a core of explosive material surrounded by at least onelayer of textile material, the textile material having watersoluble or water-swellable macromolecular material in contact therewith, or sufficiently near to flow into contact therewith on dissolution in water. When the end of such a fuse-cord is immersed in water, the macromolecular material forms an aqueous gel which slows the migration of water through the textile layer.

The macromolecular material may be applied to the textile material as a dry powder which may be coated on the textile material or sprinkled into it as it is wound around the explosive core. It may also, if desired, be coated on the textile material as a solution and the solvent dried to leave the material coated or impregnated with the macromolecular material. However, in a preferred construction of cord the macromolecular material is carried by a substrate which is wrapped around the explosive core adjacent to the textile layer.

The substrate may have macromolecular material on one or both sides and it may be porous, non-porous, woven or non-woven. Preferably, however, the substrate is a porous substrate which may be impregnated with at least part of the macromolecular material. An especially convenient substrate is porous cloth or paper. It may conveniently be provided as a tape applied continuously around the fuse-cord core as the fuse-cord is being manufactured in the same manner as the aforementioned thin tube is formed immediately around the explosive core in conventional fuse-cords and, if desired, it may replace this tube. However, the preferred fuse-cord has at least two layers of textile wrappings and the substrate tape carrying the macromolecular material is located between the two layers.

The macromolecular material may conveniently comprise such water-soluble thickening materials as polysaccharides, for example natural gums and cellulose derivatives, but the preferred material is a water-soluble alginate, for example sodium alginate. The alginate is especially advantageous in that it can remain as a dry coating on a substrate tape without becoming sticky and the tape can be easily used in roll form in the fuse-cord manufacturing process without 'blocking' in the roll. Alginate is further advantageous in that it is effective to prevent that ingress of oil into a fuse-cord either through the end of the cord or through the side and this is beneficial with plastics coated fuse-cord used in contact with ammonium nitrate/fuel oil (ANFO) where the fuel oil tends to penetrate the plastics wrapping.

The explosive core is preferably in powder form and may, for example, comprise blackpowder in a safety fuse-cord or crystalline pentaerythritol tetranitrate in detonating cord. In detonating cord the explosive powder may be coated with a waterproofing agent, for example silicone, but for use in deep water the powder should preferably be mixed with a water-gellable material, for example guar gum, or a salt of carboxymethyl cellulose.

In addition to the explosive core, textile wrappings and macromolecular material, the fuse-cord may have other wrapping layers, for example for reinforcing or waterproofing the cord. Thus, as in conventional fuse-cords, there is conveniently a thin tube of paper or plastics immediately surrounding the explosive core and an outer waterproof envelope, for example, of plastics material such as polyethylene or PVC. In some constructions of fuse-cord where the explosive material in the core is in dry powder form, a central textile yarn is introduced to assist the flow of the core material in the manufacture of the fuse-cord, and it is in some cases beneficial to apply water-soluble macromolecular material to this yarn also.

The invention also includes a method of manufacturing an explosive fuse-cord which comprises continuously forming a fuse core of explosive material, surrounding the core with at least one layer of textile material and placing water-soluble macromolecular material in contact with the said layer of textile material, or sufficiently close to flow into contact with the textile material on dissolution in water.

Preferably the macromolecular material is carried on a tape substrate which is continuously formed into a tube around the explosive core and in contact with the layer of textile material as the fuse-cord is manufactured. Thus, the tape may be convoluted longitudinally into tubular form by passing it through a forming die through which the explosive core is also being fed.

In order to illustrate the invention further, the construction and manufacture of a preferred form of detonating fuse-cord is hereinafter described, by way of example only, with reference to the accompanying drawing which shows diagrammatically a length of fuse-cord with one end dissected.

The fuse-cord has a central core 1 of crystalline pentaerythritol tetranitrate enclosed in a thin tube 2 formed by continuously passing a longitudinal paper tape through a die which folds it around its longitudinal axis so that the edges overlap. The core 1 is formed by continuously feeding PETN into the tube 2 as the tube is being formed. In the centre of the core 1 is a central yarn 3 to assist the flow of PETN into the tube 2.

The tube 2 is surrounded by a spun layer of textile yarns 4, a counter-spun layer of textile yarns 5 and a waterproof plastics sheath 6. As shown in the drawing a tube 7 consisting of a substrate tape carrying water-soluble macromolecular material is positioned between the textile layers 4 and 5, but it will be understood that the tube 7 could occupy different positions adjacent to the textile layers 4 and 5 and could, if desired, be used in place of the tube 2. The water-soluble macromolecular material could also be incorporated in the textile yarns 4 and 5 without a substrate tape. The fuse-cord is redily manufactured using the apparatus normally used in the manufacture of spun fuse-cords.

The following specific examples of detonating cords of the aforedescribed construction further illustrate the invention.

In the Examples, the explosive core 1 was crystalline PETN, loaded at a charge rate of 10 g per meter into a tube 2 formed from 13 mm wide × 0.08 mm thick glazed Kraft paper transport tape. The yarn 3 was 1,000 denier polypropylene tape 3.0 mm wide and 0.08 mm thick having a twist of 80 turns per meter. The wrapping yarns in the layers 4 and 5 were 1,000 denier polypropylene tape (as yarn 3 but without twist), the layer 4 consisting of 10 yarns helically wound at 26 turns per meter and the layer 5 consisting of eight yarns helically wound at 39 turns per meter. The sheath 6 was extruded polyethylene.

The tube 7 consisted of porous paper tape substrate 14 mm wide coated on one side with sodium alginate (plasticised with about 1% of glycerine) and positioned as described in the accompanying table. The water resistance of the fuse-cords of the Examples was tested by measuring the extent of water penetration into a length of fuse-cord when one exposed end was immersed in water at depths of 2 and 15 meters respectively with the other end above the water surface. Details of the tests are given in the table. Unless otherwise indicated, the macromolecular material in the textile layers was introduced between the layers 4 and 5. The sodium carboxymethyl cellulose in Example G had a viscosity of 3,700 cps in 1% aqueous solution at 20°C. For comparison, the table includes details of tests on Examples H and J, fuse-cords not containing water-soluble macromolecular material in contact with the textile wrapping layers 4 and 5 and therefore not in accordance with the invention, but otherwise identical to Examples A to G.

The results show that the introduction of water-soluble macromolecular material into the textile wrapping materials of the fuse-cord markedly improves the water resistance of the cord.

TABLE

| Example | Macromolecular Material in Textile Layer | Amount and Mode of Application | Macromolecular Material in Explosive core | Water Penetration (cm) at 2 m | Water Penetration (cm) at 15 m |
|---|---|---|---|---|---|
| A | Sod Alginate | 0.385 g/m on tape | Nil | 3.0 | 30.0 |
| B | " | 0.193 g/m on tape | Nil | 5.0 | 47.0 |
| C | " | 0.385 g/m on each of 2 tapes | Nil | 1.5 | 22.0 |
| D | " | 0.385 g/m on tape | 2% Sod Alginate | 2.5 | 15.0 |
| E | " | 0.3 g/m loaded as powder | Nil | 5.0 | 45.0 |
| F | " | 0.3 g/m loaded as powder | 2% Sod Alginate | 2.5 | 32.0 |
| G | SCMC | 0.3 g/m solution coated on individual yarns in layers 4 and 5 | Centre Yarn SCMC coated | 6.5 | 47.0 |
| H | Nil | — | 2% Sod Alginate | 30.0 | 63.0 |
| J | Nil | — | Nil | 135.0 | 700.0 |

What we claim is:

1. A dry-spun detonating fuse-cord comprising a core of dry particulate explosive material, supporting materials comprising at least one layer of textile material surrounding said core, and at least one water-gellable macromolecular material disposed around said core in contact with said textile material whereby, when the end of said fuse-cord is immersed in water, an aqueous gel of macromolecular material is formed which slows water migration through the textile layer.

2. A fuse-cord as claimed in claim 1 where in the macromolecular material is in the form of a dry powder.

3. A fuse-cord as claimed in claim 1 wherein the macromolecular material is in the form of a coating applied as a solution to the textile material.

4. A fuse-cord as claimed in claim 1 wherein the macromolecular material is carried by a substrate wrapped around the explosive core adjacent to the textile layer.

5. a fuse-cord as claimed in claim 4 wherein the substrate is a porous substrate impregnated with at least part of the macromolecular material.

6. A fuse-cord as claimed in claim 4 wherein the substrate is porous cloth or paper.

7. A fuse-cord as claimed in claim 4 wherein the substrate comprises a tape applied continuously around the fuse-cord.

8. A fuse-cord as claimed in claim 7 wherein the tape is disposed immediately around the explosive core.

9. A fuse-cord as claimed in claim 7 wherein there are two layers of textile wrappings and the tape is located between the two layers.

10. A fuse-cord as claimed in claim 1 wherein the macromolecular material comprises a polysaccharide.

11. A fuse-cord as claimed in claim 10 wherein the macromolecular material is selected from the group consisting of natural gums, water-soluble cellulose derivatives and water-soluble alginates.

12. A fuse-cord as claimed in claim 11 wherein the macromolecular material is selected from the group consisting of sodium alginate and sodium carboxymethyl cellulose.

13. A fuse-cord as claimed in claim 1 wherein the explosive core comprises an explosive selected from the group consisting of blackpowder and pentaerythritol tetranitrate.

14. A fuse-cord as claimed in claim 1 wherein the explosive core comprises a core of detonating explosive powder coated with a waterproofing agent.

15. A fuse-cord as claimed in claim 1 having a central textile yarn treated with water-soluble macromolecular material.

16. An explosive fuse-cord comprising a core of explosive material, supporting materials comprising at least one layer of textile material surrounding said core, and at least one water-gellable macromolecular material in close proximity to said textile material, said macromolecular material being carried by a substrate wrapped around the explosive core adjacent the textile layer, whereby, when the end of said fusecord is immersed in water, an aqueous gel of macromolecular material is formed which slows water migration through the textile layer.

17. A fuse-cord as in claim 16 wherein the substrate is a porous substrate impregnated with at least part of the macromolecular material.

18. A fuse-cord as in claim 16 wherein the substrate is porous cloth or paper.

19. A fuse-cord as in claim 16 wherein the substrate comprises a tape applied continuously around the fuse-cord.

20. A fuse-cord as claimed in claim 19, wherein the tape is disposed immediately around the explosive core.

21. A fuse-cord as in claim 19 wherein there are two layers of textile wrappings and the tape is located between the two layers.

22. In the dry spinning process for the manufacture of detonating fuse-cord wherein an explosive core is continuously formed from dry particulate explosive material and surrounded by supporting material comprising at least one layer of textile material, the improvement comprising the step of disposing around said explosive core in contact with said textile material at least one water-gellable macromolecular material whereby, when the end of said fuse-cord is immersed in water, an aqueous gel of macromolecular material is formed which slows water migration through the textile layer.

23. A method as claimed in claim 22 wherein the macromolecular material is carried on a tape substrate which is continously formed into a tube around the explosive core and in contact with the layer of textile material.

24. A method as claimed in claim 23 wherein the tape is convoluted longitudinally into tubular form by passing it through a forming die through which the explosive core is also fed.

25. A method as claimed in claim 22 wherein the macromolecular material is applied to the textile material as a dry powder.

26. A method as claimed in claim 25 wherein the powdered macromolecular material is coated or sprinkled on the textile material as the textile material is wound around the explosive core.

27. A method as claimed in claim 22, wherein the textile material is coated or impregnated with a solution of the macromolecular material and dried.

* * * * *